US006007959A

United States Patent [19]

Matsuoka et al.

[11] Patent Number: 6,007,959

[45] Date of Patent: Dec. 28, 1999

[54] METHOD FOR MAKING AN IMAGE FROM A MATERIAL COMPRISING RESIN PARTICLES AND RECORDING COMPONENT HELD INSIDE THE RESIN PARTICLES

[75] Inventors: Hirotaka Matsuoka; JongWon Lee, both of Minami-Ashigara, Japan

[73] Assignee: Fuji Xerox Co., Ltd., Tokyo, Japan

[21] Appl. No.: 08/731,911

[22] Filed: Oct. 22, 1996

[30] Foreign Application Priority Data

Oct. 25, 1995 [JP] Japan ..... 7-278112

[51] Int. Cl.[6] ..... G03G 9/08

[52] U.S. Cl. ..... 430/118; 347/264

[58] Field of Search ..... 347/264; 346/140.1; 523/161, 200, 201, 202, 203, 204, 205; 430/138, 118

[56] References Cited

U.S. PATENT DOCUMENTS

| | | | |
|---|---|---|---|
| 4,470,055 | 9/1984 | Todoh | 346/140 R |
| 4,565,764 | 1/1986 | Nakahara et al. | 430/111 |
| 5,209,998 | 5/1993 | Kavassalis et al. | 430/106 |
| 5,529,873 | 6/1996 | Chiba et al. | 430/109 |

FOREIGN PATENT DOCUMENTS

| | | |
|---|---|---|
| 57-29460 | 2/1982 | Japan . |
| 57-29460 | 12/1982 | Japan . |
| 62-60690 | 3/1987 | Japan . |
| 1-110971 | 4/1989 | Japan . |
| 1-136761 | 5/1989 | Japan . |
| 1-136762 | 5/1989 | Japan . |
| 1-136763 | 5/1989 | Japan . |
| 4-296587 | 10/1992 | Japan . |

*Primary Examiner*—Benjamin R. Fuller
*Assistant Examiner*—Christina Annick
*Attorney, Agent, or Firm*—Oliff & Berridge, PLC

[57] ABSTRACT

An image forming material which comprises fine resin particles and a recording component held inside the fine resin particles. The recording component comprises a colorant and water, and the fine resin particles can, when supplied with an electric energy, release the recording component held inside. The image forming material is brought into contact with a latent image holding body on which a latent image has been formed. Then an image is produced by applying an electric energy on the image forming material for the liquefaction thereof to wet and develop the latent image on the latent image holding body with the recording component contained in the image forming material.

9 Claims, 3 Drawing Sheets

METHOD FOR MAKING AN IMAGE FROM A MATERIAL COMPRISING RESIN PARTICLES AND RECORDING COMPONENT HELD INSIDE THE RESIN PARTICLES

BACKGROUND OF THE INVENTION

1. Field of the Invention

The present invention related to a novel image forming material based on a material, the fluidity of which varies by the application thereon of an electric energy, and to a method for making an image by using the material.

2. Description of Related Art

In wet development processes for electrostatic photographs, almost all of the carrier liquids which have been hitherto proposed for wet development are organic solvents having high vapor pressures. Therefore, problems common to these processes are as follows: (1) Treatment of the carrier liquid vapor discharged is necessary at, for example, the time of fixing operation; (2) Some of the carrier liquids are inflammable; and (3) After the fixing treatment on such a substrate as paper, residual solvents in the substrate gradually evaporate and the copies generate the odors of the solvent. As a result, these processes cannot satisfactorily meet the recent requirements for environmental conservation.

As a means to avoid the above-mentioned problems, proposed are wet-process developers which are mainly composed of water or a water-soluble solvent that is safe and harmless to office environments and humans and developing methods using the same, such methods as wetting development, flight development, suction development, ink mist development and two-step development, which involve utilizing electroconductive developers.

Of these development methods proposed hitherto, one developing method where a photosensitive body and a developer liquid comes into direct contact with each other, makes it impossible to avoide the smearing of image and the adhesion of the liquid to the entire surface of paper because the developer wets the entire surface of the photosensitive body. A non-contact development system causes, in addition to the above-mentioned smear problem, an undesirable suction of a wet developer into the periphery of image, with the result that the fogging of the image and the bleeding at the fine lines of the image are not avoided. And, none of the development methods of prior art have provided satisfactory quality of image.

To solve these technical problems, one of the measures that have been proposed hitherto is the application of a molecular gel which causes a phase transition by such influencing factors as temperature, solvent composition, pH, ion concentration and electric field.

Details of molecular gels are described, for example, in "Materials having molecular functions and development of elements, Chapter 2, Elements" by the supervision of Takao Shimizu (published by NTS in 1994). Technical literatures other than this also provide the descriptions suggestive of the possibility that above-mentioned phenomenon may be utilized for a sensor, an actuator and a reactor, conversion elements for converting chemical energy into mechanical energy, artificial muscle, a display and a marking device.

For example, Japanese Patent Application Laid-Open (JP-A) Nos. 62-60,690 and 01-110,971 describe a direct marking process comprising the steps of directly supplying current to a gel by means of pattern-shaped, voltage applying electrodes to form an adhesive sol of ink and transferring the ink. Japanese Patent Application Laid-Open (JP-A) Nos. 01-136,761, 01-136,762 and 01-136,763 describe a direct marking process comprising the steps of sandwiching a gel between an absorbent membrane and a porous material held on an electroconductive substrate and supplying a current to the foregoing combination to discharge an ink, which will be transferred to paper through the porous material. None of these proposals has not been put into practice because of the problem of response speed to the volume change of the gel and of the stability at the time of repetitive use.

SUMMARY OF THE INVENTION

Accordingly, the first object of the present invention is to provide a novel image forming material that improves the response speed and stability problems, which are disadvantages of the above-mentioned electroconductive wet-process developers, and that can provide a good image quality free of the fogging of image and the bleeding of the fine lines of image as well as of the smearing of the image.

The second object of the present invention is to provide a method for making an image by a wet process utilizing a novel image forming material that enhances the response speed and improves the stability and that enables the high-speed manufacture of prints utilizing a photosensitive body.

The present inventors have accomplished the invention based on the discovery that by means of a polymeric gel-based developer comprising fine resin particles which, when supplied with electric energy, releases the liquid that has been held inside and absorb the liquid when not supplied with the electric energy, a recording component comprised of a colorant, a solvent such as water or water-soluble solvent and optionally a response accelerator, only an electrostatic latent image is selectively wetted, for development, with the released recording component, to solve the aforementioned problems thus providing repeatedly a good image free of bleeding, and based on making it sure that the foregoing method can be applied to an ordinary electrophotographic process.

Accordingly, the present invention relates to an image forming material comprising fine resin particles and a recording component held inside them, wherein the recording component comprises a colorant and a solvent and wherein the fine resin particles can, by the application of an electric energy, release the recording component held inside them.

According to the image forming material of the present invention, the response speed and stability, which are the problems of the conventional electroconductive wet developers, are improved and a good image quality, free of the fogging of image and the bleeding of fine lines of the image as well as of the smearing of the image, can be obtained in a stable manner.

The image forming material comprises resin particles that hold a recording component inside them, and is characterized in that virtually the material is a solid at room temperature which, when impressed with an electric energy, is converted into a liquid. Besides, it is preferred that the particles further contain a response accelerator.

Preferably, the fine resin particles are made of a resin that has a three-dimensionally cross-linked structure derived from an acrylamide derivative monomer and/or an acetamide derivative monomer. An average particle size of the fine resin particles, when they contain the recording component, is in the range of 0.1 to 100 $\mu$m.

Preferably, the solvent which is an ingredient of the recording component is water, and the response accelerator is selected from the group consisting of a polar solvent, a solid electrolyte and a surface active agent.

The method for making an image according to the present invention comprises the steps of providing a latent image holding body on which a latent image has been formed; providing an image forming material that is virtually a solid at room temperature and is converted into a liquid when supplied with an electric energy; and applying an electric energy onto the image forming material to be liquefied, thereby wetting and developing the latent image on the latent image holding body with the recording component contained in the image forming material.

The method for making an image according to the present invention enables the response speed and stability improved, and the high-speed manufacture of prints utilizing a photosensitive body.

Preferably the method for making an image according to the present invention increases the electrostatic attraction force which acts between the electrostatic latent image on the latent image holding body and the recording component of the image forming material, selectively in the area corresponding to the electrostatic latent image, and permits to wet and develop the electrostatic latent image with the recording component contained in the image forming material.

The electric energy to be applied is preferably selected from the electrostatic latent image, electric field of direct current and direct current corresponding to image information.

The electric energy may be from 0.01 to 50 V/$\mu$m, preferably 0.1 to 10 V/$\mu$m. Energy applying time is preferably from 0.01 to 5 sec.

In the method for making an image according to the present invention, preferably images are produced in a repetitive manner by supplying a recording component to the image forming material.

In the image forming material according to the present invention, owing to the fine resin particles which, when supplied with an electric energy, release the liquid that is held inside them and, when not supplied with an electric energy, absorb the liquid, it is possible to control electroconductivity-related phenomena, such as fluidity, adhesiveness, electrostatic attraction force toward the latent image of the photosensitive body and wettability of the developer facing the latent image of the photosensitive body that is image information, by adjusting the electric energy. As a result, it is possible to sufficiently enhance the electrostatic attraction force or adhesion to the latent image of the photosensitive body in image areas, and to nullify or sufficiently lower the electrostatic attraction force or adhesion in non-image areas, thus enabling to obtain a good image.

More specifically, the image forming material is provided with the electrostatic latent image, electric field of direct current or direct direct current corresponding to image information to cause the release of the recording component comprising a colorant and a solvent such as water thereby increasing the attraction force or adhesion to the latent image.

DESCRIPTION OF PREFERRED EMBODIMENTS OF THE INVENTION

Figure 1:
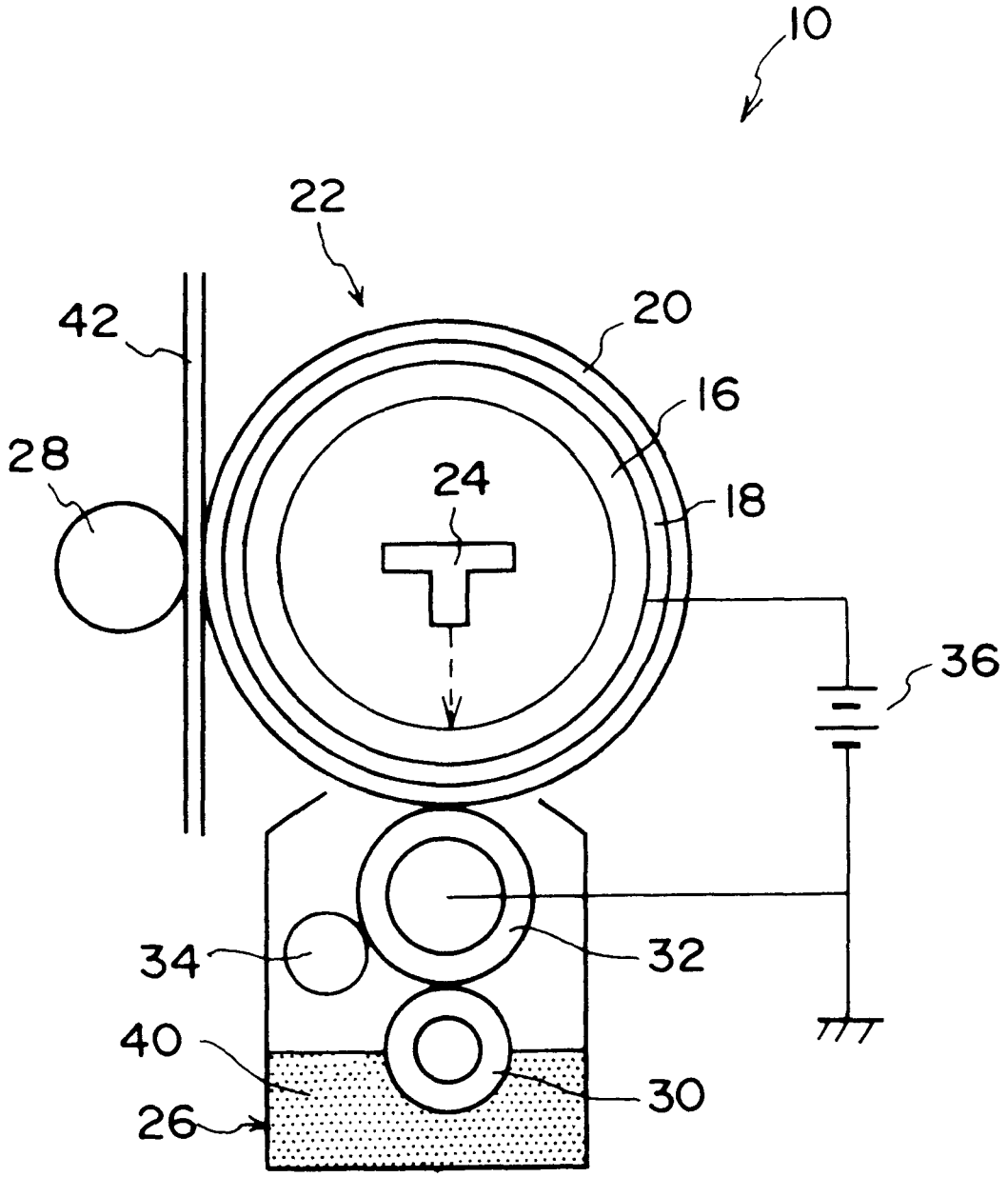
FIG. 1 is a diagrammatically shown cross-sectional view illustrating an apparatus for making an image.

The present invention will be explained in detail below.

The fine resin particles which are used in the image forming material of the present invention, preferably have a three-dimensional, cross-linked structure derived from a monomer selected from the group consisting of an acrylamide derivative and an acetamide derivative. From the viewpoint of the improvement of response speed and of the capability of repeated use in an ordinary electrophotographic process, the adding amount of any one type of the fine resin particles is usually in the range of not more than 50 percent by weight, preferably in the range of 0.1 to 10 percent by weight, based on the total weight of the image forming material.

Generally, the image forming material of the present invention consists essentially of 3 to 4 constituents that are described below in detail. The wording "consists essentially of" means that any component which does not impedes advantages of the developer, is not excluded from the composition. For example, additional constituents, utilized in a well-known developer, may be present which include finely divided metal oxides, metal soaps, fine resin particles, physical property adjusting agents and other auxiliary materials. The above-mentioned 3 or 4 components are fine resin particles, a dye or a pigment as a colorant, a solvent such as water or organic solvent for dispersing the foregoing components, and optionally a response accelerator.

The fine resin particles, which is used in the present invention to release the liquid that is held in the resin when an electric energy is applied, are a polymeric gel having a small particle size. For this purpose, usable are a well-known heat-responding gel having a small particle size and a gel whose volume changes depending on the concentration of proton.

A suitable example of material that forms the fine resin particles is a three-dimensionally crosslinked polymer made from monomers which include acrylamide and an N-substituted acrylamide derivative having a lower alkyl or alkylene radical introduced into the amide group, or otherwise acetamide and an N-substituted acetamide derivative. The weight average molecular weight is preferably from $10^3$ to $10^5$.

Examples of the acrylamide derivatives include N-acrylamide, N-ethylacrylamide, N,N-diethylacrylamide, N-methyl, N-ethylacrylamide, N-isobutylacrylamide, N,N-diisopropylacrylamide, N-isobutylacrylamide, N-cyclohexylacrylamide, N-phenylacrylamide, N-benzylacrylamide and N-isopropyloxyacrylamide. Besides, examples of the acetamide derivatives include N-vinylacetamide, N-vinylisobutylamide and N,N-diisobutylamide.

Examples of the monomers which can be copolymerized with the above-mentioned acrylamide-based monomers or acetamide-based monomers and which are non-polar or polar, include acrylic acid, an acrylic acid ester, acrylonitrile, styrene, vinylacetate, maleic acid ester, acrolein, 1,2-dimethyl-5-vinylpyridinium methyl sulfate, methacylamide, N-methylol acrylamide, 2-methyl-5-vinylpyridine, sodium vinylsulfonate and vinylidene chloride.

Examples of the monomers which can be used for crosslinking the above-mentioned acrylamide-based monomers or acetamide-based monomers, include N, N'-methylene bisacrylamide, ethylene glycol dimethacrylate, glycerin triacrylate and divinyl benzene.

The fine resin particles may be produced by any of known polymerization methods which include emulsion polymerization, reverse-phase suspension polymerization, precipitation polymerization and dispersion polymerization.

Examples of an initiator which can be used in an aqueous solvent system, include ammonium sulfate-sodium hydrogensulfate and hydrogen peroxide-Fe(I). Examples of an initiator, which can be used in a nonaqueous solvent system, include azoisobutylonitrile, cumene hydroxyperoxide and azobiscyclohexane carbonitrile.

As the fine resin particles, polymeric gels can also be used which have been hitherto known as heat-sensitive gels and which are made from monomers such as styrene sulfonic acid, 2-acrylamide-2-methylpropane sulfonic acid and trimethyl(N-acrylol-3-aminopropyl)ammonium chloride. In addition, usable in the present invention are amino-containing polymeric gels comprising amine or acrylamine, which exhibit volume change depending on the change of the concentration of proton or on the change of ion or solvent composition, as well as copolymers of polyvinyl alcohol and acrylic acid.

When an image forming material is prepared from these fine resin particles together with the recording component comprising a colorant and a solvent, the resin particles hold the recording component inside them and are virtually in a solid state. When supplied with an electric energy, they release the recording component that has been held therein. When macroscopically observed, the above-described function can be supported by a phenomenon that a substance which is virtually a solid at room temperature is converted into a liquid by the application of an electric energy.

That is, according to an embodiment of the present invention, the image forming material is virtually a solid at room temperature and is converted into a liquid having a viscosity of not greater than $10^4$ mPas by the application of an electric energy. Therefore, when, for example, the electrostatic attraction force generated between an electrostatic latent image on a photosensitive body and the recording component is increased selectively only on the area that corresponds to an image area, the recording component on the area that corresponds to the image is released as a liquid to selectively wet the above-mentioned area alone, with the released recording component. As a result, an image making process is effected. The area which corresponds to the non-image area and to which no recording component is released, is not colored, thus leading to an excellent quality of image.

The sizes of the fine resin particles, which may depend on their volume change ratios, are in the range of 0.1 to 100 $\mu$m, preferably 0.1 to 20 $\mu$m, when they are not supplied with an electric energy, that is, they hold the recording component. The fine resin particles the sizes of which exceed 100 $\mu$m undesirably lower the response speed of the gel, whereas the fine resin particles the sizes of which are less than 0.1 $\mu$m have an insufficient holding amount of the recording component and poor handling property.

The fine resin particles having the desired particle sizes may be prepared by adjusting the synthesis condition thereof. In addition, the gel polymers obtained by synthesis and drying may be subjected to a known pulverizing procedure such as pulverizing in gas stream, pulverizing in frozen state or impacting.

The second constituent of the image forming material of the present invention is a dye or a pigment as a colorant. The colorant may be selected from known dyes and pigments provided that they have desired properties including durability. These dyes and pigments may be used alone or in a combination of two or more of them.

The water-soluble dyes that can be used as a colorant are those which are indicated as acid dyes, direct dyes, basic dyes, reactive dyes and food dyes in Color Index and which have excellent water resistance and light fastness. Examples of usable dyes include C.I. Acid Yellow 17, 23, 42, 44, 79, 142; C.I. Acid Red 1, 8, 13, 14, 18, 26, 27, 35, 37, 42, 52, 82, 87, 89, 92, 97, 106, 111, 114, 115, 134, 186, 249, 254, 289; C.I. Acid Blue 9, 29, 45, 92, 249; C.I. Acid Black 1, 2, 7, 24, 26, 94; C.I. Food Yellow 3, 4; C.I. Food Red 7, 9, 14; C.I. Food Black 2; C.I. Direct Yellow 1, 12, 24, 26, 33, 44, 50, 86, 142, 144; C.I. Direct Red 1, 4, 9, 13, 17, 20, 28, 31, 39, 80, 81, 83, 89, 225, 227; C.I. Direct Orange 26, 29, 62, 102; C.I. Direct Blue 1, 2, 6, 15, 22, 25, 71, 76, 79, 86, 87, 90, 98, 163, 165, 199, 202; C.I. Direct Black 19, 22, 32, 38, 51, 56, 71, 74, 75, 77, 154, 168; C.I. Basic Yellow 1, 2, 11, 13, 14, 15, 19, 21, 23, 24, 25, 28, 29, 32, 36, 40, 41, 45, 49, 51, 53, 63, 67, 70, 73, 77, 87, 91; C.I. Basic Red 2, 12, 13, 14, 15, 18, 22, 23, 24, 27, 29, 35, 36, 38, 39, 46, 49, 51, 52, 54, 59, 68, 69, 70, 73, 78, 82, 102, 104, 109, 112; C.I. Basic Blue 1, 3, 5, 7, 9, 21, 22, 26, 35, 41, 45, 47, 54, 69, 92, 93, 105, 117, 120, 122, 124, 129, 137, 141, 147, 155; C.I. Basic Black 2, 8.

As for pigments, examples of organic pigments include azo-based, phthalocyanine-base, anthraquinone-based, quinacridone-based, dioxadine-based, indigo-based, thioindigo-based, perylene-based, isoindolenone-based, aniline black based and azomethylene-based. Meanwhile, inorganic pigments include ultramarine blue, cadmium yellow, iron oxide, chromium yellow, titanium oxide and carbon black.

As colorants, besides the above-mentioned ones, also usable are colored polymers and oil-soluble dyes containing wax, and, also usable are silica, colloidal silica, metal oxides, such as aluminum oxide, magnetite or ferrites, cupric oxide, nickel oxide, zinc oxide, zirconium oxide, titanium oxide and magnesium oxide as well as mixtures thereof.

When pigments are used as a colorant, pigment dispersing agents may be used, as necessary. Examples of pigment dispersing agents include naturally occurring hydrophilic polymers, such as vegetable polymers such as gum arabic, tragacanth gum, guar gum, calaya gum, low cast bean gum, arabino galacton, pectin, queen's seed starch, mannan alginic acid, caraginan and agar, animal polymers such as gelatin, casein, albumin and collagen, microoganism-derived polymers such as xanthene gum, dextorin, succinoglukan and curdlan, semi-synthesized polymers, such as fibrous polymers including methyl cellulose, ethyl cellulose, hydroxyethyl cellulose, hydroxypropyl cellulose and carboxymethyl cellulose, starch-based polymers including starch glicolic acid sodium salt and starch phosphoric acid ester sodium salt, alginic acid-based polymers including alginic acid sodium salt and alginic acid propylene glycol ester, fully synthesized polymers, such as vinyl polymers including polyvinyl alcohol, polyvinyl pyrrolidone and polyvinyl methy ether, acrylic resins including non-crosslinked polyacrylamide, polyacrylic acid and alkali salts thereof and water-soluble styrene/acrylic resins, water-soluble styrene/maleic acid resins, water-soluble vinylnaphthalene/acrylic resin, water-soluble vinylnaphthalene/maleic acid, alkali metal salts of β-naphthalene sulfonic acid-formalin condensation products, polymeric compounds having pendant salts of cationic functional groups such as quaternary ammonium and amino groups, and naturally occurring polymers including shellac.

The concentration of the colorant may be from 0.1 to 50%, preferably from 1 to 10% by weight of the polymer material, and from 0.1 to 20, preferably from 1 to 10% by weight of the image forming material.

The third constituent of the image forming material of the present invention is a solvent in which a colorant, i.e., dye or pigment, is dispersed. Although the main solvent is water, any of the following compounds, which function as a moisture holding agent and the like, may be added to the image forming material in order to prevent the coagulation due to evaporation of water from the dispersed fine particles and coloring materials. Examples of such compounds include monohydric alcohols, such as ethanol, methanol and propanol, polyhydric alcohols, such as ethylene glycol, diethylene glycol, triethylene glycol, tetraethylene glycol, polyethylene glycol, propylene glycol, dipropylene glycol, glycerin, low-molecular-weight polyethylene glycol and hexylene glycol, alkyl ethers of polyhydric alcohols, such as ethylene glycol monobutyl ether, diethylene glycol monomethyl ether, triethylene glycol monomethyl ether, tetraethylene glycol monomethyl ether, ethylene glycol monomethyl ether and propylene glycol monoethyl ether, aryl ether of polyhydric alcohols, such as ethylene glycol monophenyl ether and ethylene glycol monobenzyl ether, nitrogen-containing heterocyclic compounds, such as N-methyl-2-pyrrolidone, 1,3-dimethyl imidazolidinone, ε-caprolactam and γ-butyrolactone, amides, such as formamide, N-methyl formamide and N,N-dimethyl formamide, amines, such as monoethanol amine, diethanol amine, triethanol amine, monoethyl amine, diethyl amine and triethyl amine, sulfur-containing compounds, such as dimethyl sulfoxide and sulfolane, propylene carbonate, and ethylene carbonate. A single compound or a combination of two or more of the compounds may be used together with water as a mixture.

The solvent may be used in an amount of from 1 to 80%, preferably from 1 to 20% by weight of the image forming material.

A surface active agent may be added to the recording component for adjusting the surface tension thereof. As the surface active agent, use may be made of a variety of surface active agents which include anionic, cationic, nonionic and amphoteric. These may be used alone or in a combination of two or more. The examples of anionic surface active agents include alkylbenzene sulfonic acid salts, the examples of cationic surface active agents include alkyl dimethyl ammonium salts, the examples of nonionic surface active agents include polyoxyethylene derivatives such as a polyethylene glycol alkyl ether and a higher alcohol ester of sugar, and the examples of amphoteric surface active agents include sulfobetaine-based types and amino acid-based types.

Besides, when necessary, various other agents can also be used which include a pH buffer, a dye dissolving agent, a viscosity controller, such as ammonium hydroxide, sodium hydroxide, urea, gum arabic or polyvinyl alcohol, and a biocide, and antifungal agent.

In order to provide a preferred embodiment of the present invention, the above-mentioned three main components are used together with a response accelerator, which has the function to facilitate, when a current is applied, the release of the liquid held inside the fine resin particles. This function can also be performed by polar solvents, such as alcohol and acetone that are used as a solvent, and by surface active agents incorporated in the recording component. In addition, the compounds that are usable as a response accelerating agent include a variety of solid electrolytes. Examples of the solid electrolytes include potassium chloride, sodium chloride, potassium iodide, sodium iodide, potassium thiocyanate, potassium bromide, sodium bromide, tetraethyl ammonium bromide, $LiBF_4$, $KPF_6$ and $NaClO_4$ as well as alkyl sulfate ester salts, lauryl sulfate salts, higher alcohol sulfate salts, succinates, carboxylates, polyethylene glycol ether sulfate ester salts, amide sulfuric acid salts, disulfonic acid salts, polyoxyethylene lauryl ether sulfate salts, polyoxyethylene alkyl ether acetate, alkylphosphates, polyoxyethylene alkyl ether phosphates, alkyl ammonium salts, alkylbenzyl ammonium salts, perfluoroalkylammonium salts, perfluoroalkylsulfonate salts, carboxylic acid salts, and phosphoric acid esters. The adding amount of the electrolyte as a response accelerating agent is in the range of 0.0001 mole/liter (of a solvent) to a saturated solubility and preferably in the range of 0.005 mole/liter to a saturated solubility. An amount of the electrolyte less than 0.0001 mole/liter brings about no effect in the acceleration of the response speed, whereas an amount exceeding the saturated solubility undesirably makes the system heterogeneous.

Below, the method for making an image by use of the image forming material is described in detail. An apparatus for making an image by use of the image forming material of the present invention comprises a light-transmissive electroconductive layer over a light-transmissive support and a light source that irradiates light from the side of the support.

FIG. 1 is a schematically illustrated cross-sectional view of an apparatus for making an image by use of the wet developer of the present invention.

An apparatus for making an image 10 comprises a drum-shaped photosensitive body 22, which is made by laminating a light-transmissive electroconductive layer 18 and a photoconductive layer 20 onto a light-transmissive support 16, an LED head 24 as a light source placed within the drum-shaped photosensitive body 22, a developer feeding chamber 26 positioned under the photosensitive body 22 and a transfer roll 28 which faces the side of the photosensitive body 22. The LED head 24 is positioned opposite the developer feeding chamber 26 via a part of the photosensitive body 22. The developer feeding chamber 26 is equipped, for example, with a developer feeding roll 30, a developer holding roll 32 positioned opposite thereto and a developer layer adjusting roll 34 that abuts against the developer holding roll 32 so that the image forming material (developer) 40, which has been stored in the developer feeding chamber 26, is applied on the developer holding roll 32 with the roll 30 to be transferred to the outer periphery of the photosensitive roll 22 after being adjusted to a desired thickness of layer by means of the developer layer adjusting roll 34.

Between the developer holding roll 32 and the light-transmissive electroconductive layer 18, there is positioned a bias electric power source 36 to supply both of the foregoing with a voltage that corresponds to the property of the potential of the photosensitive body 22. In addition, a means (not shown) of rotating the photosensitive body 22 is also provided.

Figure 2A:
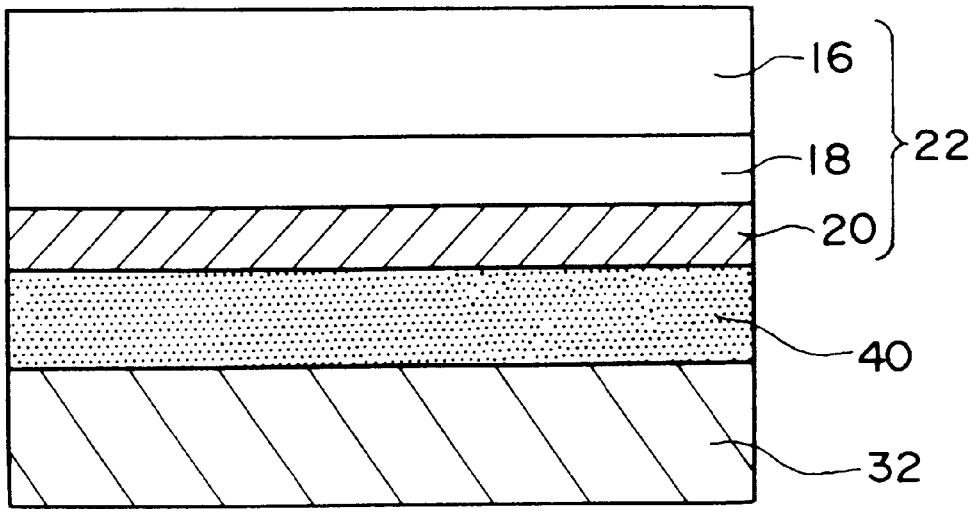
FIG. 2A is an enlarged cross-sectional view illustrating the contact area between a developer holding roll and a photosensitive body of the apparatus for making an image of FIG. 1, wherein the developer holding roll has a smooth surface.
Figure 2B:
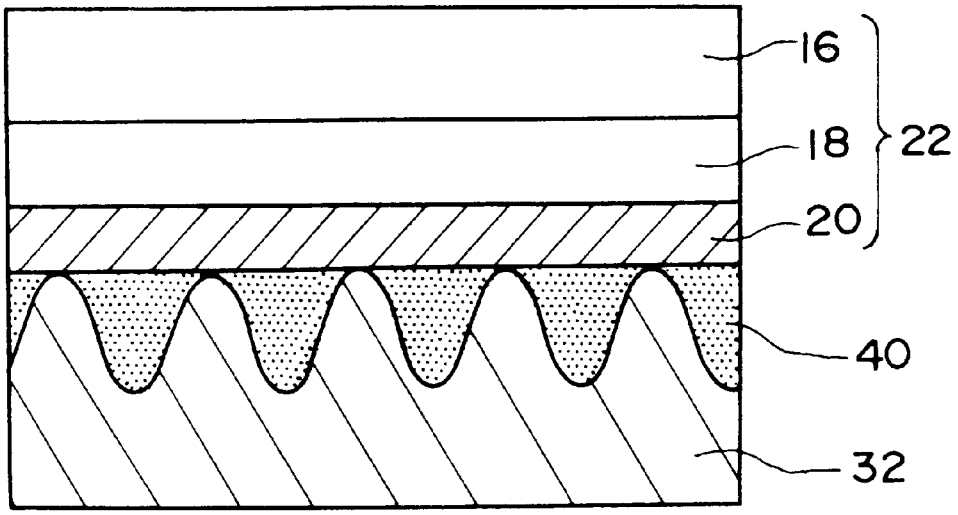
FIG. 2B is an enlarged cross-sectional view similar to FIG. 2A except that a developer holding roll is used which has an irregularity on the surface.
Figure 3:
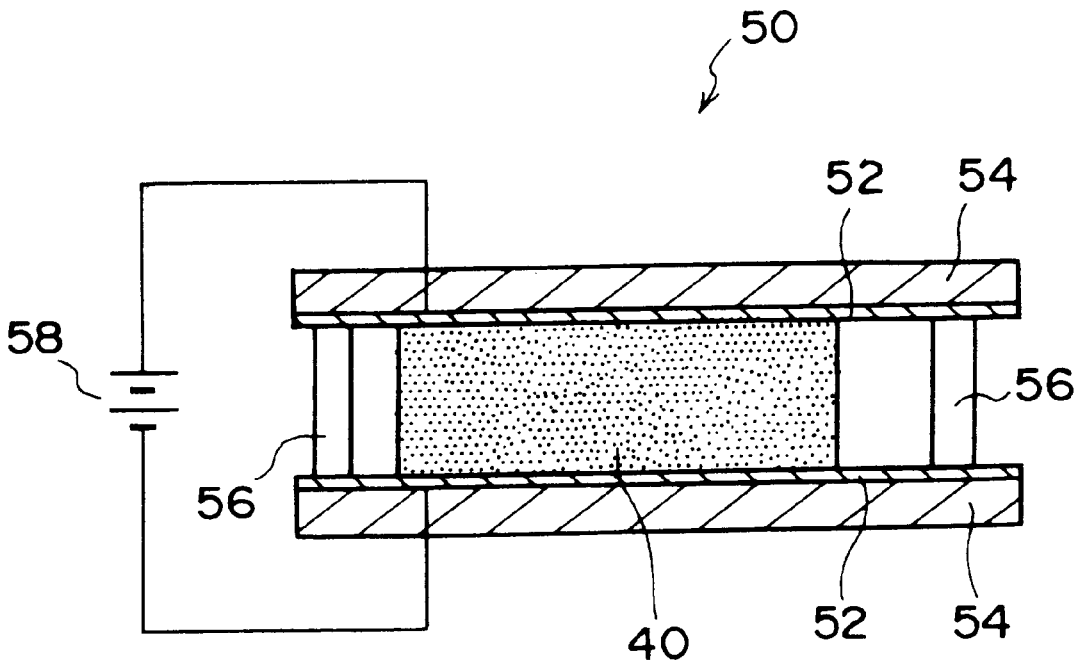
FIG. 3 is a conceptual view illustrating an apparatus for evaluating electric field-induced shrinkage, to measure the viscosity of the image forming material of the present invention.

As the substrate which constitutes the developer holding roll 32, such materials as iron, nickel, aluminum, copper, stainless steel and platinum are utilized in pure form or after being vacuum deposited, for example, with polyimide, if necessary. The surface of the developer holding roll 32 may be smooth as shown in FIG. 2A or may be provided with pyramid-shaped fine irregularity that resembles a gravure roll as shown in FIG. 2B. The fine irregularity may be in the configuration of a grid or of slant lines. FIG. 2 is an enlarged cross-sectional view illustrating the contact area between the developer holding roll 32 and the photosensitive body 22. On the surface of the developer holding roll 32, there is provided a layer of the developer 40 which is brought into contact with the surface of the photosensitive body 22 so that a layer of the recording component which is to be released from the resin particles in response to the application of the voltage, will be provided on the surface of the photosensitive body 22.

The materials usable for the light-transmissive support 16, which are used for the electrophotographic photosensitive body 22 that has at least a light-transmissive electroconductive layer 18 and a photoconductive layer 20 and that is capable of back-light recording, include transparent inorganic materials, such as glass, quartz and sapphire, and transparent organic resins such as fluorocarbon resins, polyesters, polycarbonates, polyethylene terephthalates, acrylic resins, polyimides and epoxy resins.

The materials usable for the light-transmissive electroconductive layer 18 may be transparent electroconductive materials which include ITO, tin oxide, zinc oxide, lead oxide and indium oxide. As illustrated, an amorphous silicon-based photoconductive layer 20, as a photosensitive layer, may be laminated.

Besides the LED head 24, laser, liquid crystal shutter, halogen lamp, EL array and the like can also be used as the light source.

Turning to FIG. 1, light exposure is performed while a direct current voltage is applied between the light-transmissive support 16 and the developer holding roll 32. An electric current signal, which is induced by the difference of electroconductivities of bright and dark conditions of the amorphous silicon-based photoconductive layer 20, causes the fluidity of the developer 40, to which the current has been applied, to be chagned. That is, the fine resin particles release the recording component. By means of an electrostatic attractive force or by an electrical capillary phenomenon or the like, the released recording component moves to the electric latent image on the photosensitive body 22 to selectively wet the latent image alone.

A recording paper 42, which has been fed from a paper feeding roll, is inserted between the photoconductive layer 20 and a backup roll 28 so that the recording component is transferred from the photoconductive layer 20 to the recording paper 42. The paper, which has the transferred recording component, is then subjected to a fixing treatment.

When direct current electric voltage is applied between the developer holding roll 32 and the light-transmissive electroconductive layer 18, the light-transmissive electroconductive layer is made an anode in the case where the fine resin particles shrink in an acidic environment, whereas the light-transmissive electroconductive layer is made a cathode in the case where the fine resin particles shrink in an alkaline environment.

Besides, the image making operation can be continued in a repeated manner by supplying the image forming material 40 to the developer feeding chamber 26.

EXAMPLES

Below, the present invention will be further explained by way of examples and comparative examples. Although the following examples and comparative examples provide the embodiments of the present invention, the present invention is not limited to them. "Part" means "part by weight" and "%" means "weight percent" in the example and comparative examples, unless otherwise specified.

Example 1

(1) Preparation of fine resin particles and an image forming material

The fine resin particles which were used in the present invention were prepared in the following manner.

| | |
|---|---|
| 1. Acrylamide | 82 parts |
| 2. Sodium acrylate | 15 parts |
| 3. N,N-methylene bisacrylamide *1 | 2 parts |
| 4. Tetramethylethylenediamine *2 | 1 part |

(*1: crosslinking agent, *2: polymerization promoter)

The above monomers were dissolved in 140 ml of water. An ammonium persulfate solution, which had been prepared by dissolving 0.1 part of ammonium persulfate in 1 ml of water, was combined with the above-described monomer solution and the resulting solution was vigorously stirred. The solution thus prepared was dripped into a solution comprising 75 ml of toluene, 25 ml of carbon tetrachloride in 1 ml of sorbitan trioleate, and the resulting solution was vigorously stirred in an atmosphere of nitrogen. After being stirred for 90 minutes at room temperature, 100 ml of hexane was added to the solution and the solution was stirred again. The solution separated into two layers, the aqueous layer of which was collected. 100 ml of hexane was added to the aqueous solution and the solution was washed under agitation. This washing operation was repeated three times. After the last wash, the hexane was evaporated by means of an evaporator, and a slurry gel was obtained. The gel was washed with water and acetone alternately and then the solvents were completely evaporated by means of a vacuum drying apparatus to obtain a dry gel polymer. The powdery gel was comminuted by use of Meteor Rotary Mill LA-P0 (available from Ito Manufacturing Co., Ltd.) to obtain gel polymer powder with a peak particle size of about 10 microns. This powder was dispersed in a 10% acetone aqueous solution and the dispersion was held in a sufficient equilibrium.

Next, Carmin 6B, a colorant (available from Dainichiseika Color & Chemical Mfg. Co., Ltd.), which had been admixed with a 10% acetone aqueous solution was charged into 01 Attritor (available from Mitsui Miike Machinery Co., Ltd.) and were subjected to milling of about 20 hours by use of steel balls having a diameter of 0.8 mm, at a rotor speed of 300 rpm, to prepare a pigment dispersion. This pigment dispersion was dispersed into the aforementioned gel. Finally, the resulting dispersion was admixed with 5 ml of 4% KCl aqueous solution, as a response accelerator, and thus a slurry image forming material (developer) was prepared.

(2) Viscosity measurement of the developer after the application of an electric energy The developer, which had been prepared in the above-described manner, was placed in an apparatus for evaluating an electric field-induced shrinkage to measure its viscosity. The apparatus for evaluating the electric field-induced shrinkage 50 comprises two sheets of transparent glass 54, each having a light-transmissive electroconductive layer 52 on the surface, which are spaced apart by an insulating spacer 56. An electric power source 58 is provided to supply a direct current voltage between the two light-transmissive electroconductive layers 52.

The developer 40 was placed in the apparatus for evaluating the electric field-induced shrinkage 50 and an electric field of 0.40 V/$\mu$m was applied between the light-transmissive electroconductive layers (ITO layers) 52 for one second. Then, the recording component oozed from the developer 40, and was collected and the viscosity measurement was conducted. The viscosity was measured at a shear rate of 1,400 $sec^{-1}$ and the results are shown in Table 1.

(3) Method for the evaluation of image and the stability in repetitive use

The obtained developer was placed in the recording apparatus of FIG. 1. An image was formed on the photosensitive body by carrying out the exposure according to the condition, i.e., wavelength: 660 nm and light exposure amount: 0.4 J/$cm^2$, while applying a voltage of +100 V between the developer holding roll and the light-transmissive electroconductive layer. The image was transferred to a sheet of recording paper. The transferred image was clear and free of bleeding and fogging of the background.

Further, image on 3,000 A4 size papers were prepared consecutively at a rate of 60 images per minute in the direction of length of A4 size. After that, respective images were evaluated in the same manner to find entirely no deterioration of the image.

Example 2

The fine resin particles of the following composition were prepared. A recording component to the fine resin particles were added thereto, to obtain an image forming material. The image forming material was subjected to the evaluation of the image, viscosity measurement and evaluation of the stability of image in repetitive use in the same manner as in Example 1.

(1) Preparation of fine resin particles and image forming materials

The fine resin particles were prepared in the following manner.

| | | |
|---|---|---|
| 1. | Acrylamide | 82 parts |
| 2. | 2-acrylamide-2-methylpropane sulfonic acid | 15 parts |
| 3. | N,N-methylene bisacrylamide *1 | 2 parts |
| 4. | Tetramethylethylenediamine *2 | 1 part |

(*1: crosslinking agent, *2: polymerization promoter)

The above monomers were dissolved in 140 ml of water. An ammonium persulfate solution, which had been prepared by dissolving 0.1 part of ammonium persulfate in 1 ml of water, was combined with the above-described monomer solution and the resulting solution was vigorously stirred. The solution thus prepared was dripped into a solution comprising 75 ml of toluene, 25 ml of chloroform and 1 ml of sorbitan trioleate, and the resulting solution was vigorously stirred in an atmosphere of nitrogen. After being stirred for 90 minutes at 70° C., 100 ml of liquid paraffin was added to the solution and the solution was stirred again. The solution separated into two layers, the aqueous layer of which was collected. 100 ml of liquid paraffin was added to the aqueous solution and the solution was washed under agitation. This washing operation was repeated three times. After the last wash, the liquid paraffin was evaporated by means of an evaporator, to obtain a slurry gel. The gel was washed with water and ethanol alternately and then the solvents were completely evaporated by means of a vacuum drying apparatus to obtain a dry gel polymer. The powdery gel was comminuted by use of Meteor Rotary Mill LA-P0 (available from Ito Manufacturing Co., Ltd.), to obtain gel polymer powder with a peak particle size of about 15 microns. This powder was dispersed in a 10% ethanol aqueous solution and the dispersion was held in a sufficient equilibrium.

Next, copper phthalocyanine (available from Dainichiseika Color & Chemicals) in a 10% ethanol aqueous solution was charged into 01 Attritor (available from Mitsui Miike) and were subjected to milling for about 20 hours by use of steel balls having a diameter of 0.8 mm, at a rotor speed of 300 rpm, to prepare a pigment dispersion. This pigment dispersion was dispersed into the aforementioned gel. Finally, the resulting dispersion was admixed with 5 ml of 4% KCl aqueous solution, as a response accelerator, and thus a developer was prepared.

(2) Evaluation of image and the stability in repetitive use

The obtained developer was placed in the recording apparatus and the evaluation of image was conducted in the same manner as in Example 1. The image transferred onto a recording paper was clear and free of bleeding and fogging of the back. Further, images on 3,000 A4 size papers were prepared consecutively at a rate of 60 images per minute in the direction of length of A4 size. After that, the images were evaluated, to find entirely no deterioration of the image.

Example 3

The fine resin particles of the following composition were prepared. A recording component to the fine resin particles were added thereto, to obtain an image forming material. The image forming material was subjected to the evaluation of image, viscosity measurement and evaluation of the stability of image in repetitive use in the same manner as in Example 1 except that the applied voltage was changed.

(1) Preparation of fine resin particles and image forming materials

| | | |
|---|---|---|
| 1. | N-vinyl isobutyl amide | 50 parts |
| 2. | N-vinyl acetamide | 32 parts |
| 3. | methacrylic acid | 15 parts |
| 4. | N,N-methylene bisacrylamide *1 | 2 parts |
| 5. | Tetramethylethylenediamine *2 | 1 part |

(*1: crosslinking agent, *2: polymerization promoter)

The above monomers were dissolved in 140 ml of water. An ammonium persulfate solution, which had been prepared by dissolving 0.1 part of ammonium persulfate in 1 ml of water, was combined with the above-described monomer solution and the resulting solution was vigorously stirred. The solution thus prepared was dripped into a solution comprising 75 ml of toluene, 25 ml of chloroform and 1 ml of sorbitan trioleate, and the resulting solution was vigorously stirred in an atmosphere of nitrogen. After being stirred for 90 minutes at 70° C., 100 ml of hexane was added to the solution and the solution was stirred again. The solution separated into two layers, the aqueous layer of which was collected. 100 ml of hexane was added to the aqueous solution and the solution was washed under agitation. This washing operation was repeated three times. After the last wash, the hexane was evaporated by means of an evaporator, to obtain a slurry gel. The gel was washed with water and ethanol alternately and then the solvents were completely evaporated by means of a vacuum drying apparatus to obtain a dry gel polymer. The powdery gel was comminuted by use of Meteor Rotary Mill LA-)P0 (available from Ito Manufacturing Co., Ltd.) to obtain gel polymer powder with a peak particle size of about 7 microns. This powder was dispersed in a 10% ethanol aqueous solution and the dispersion was held in a sufficient equilibrium.

Next, 1% Acid Blue 9 (available from Mitsubishi Chemical Corp.) aqueous solution was prepared and this solution was dispersed into the above-described gel. Finally, the resulting dispersion was admixed with 5 ml of 10% polyethylene glycol alkyl ether aqueous solution, as a response accelerator, and thus a developer was prepared.

(2) Evaluation of image and the stability in repetitive use

The obtained developer was placed in the recording apparatus of FIG. 1. An image was formed on the photosensitive body by carrying out the exposure according to the condition, i.e., wavelength: 660 nm and light exposure amount: 0.4 J/cm$^2$, while applying a voltage of +250 V between the developer holding roll and the light-transmissive electroconductive layer. The image was transferred to a sheet of recording paper. The transferred image was clear and free of bleeding and fogging of the background. Further, images on a 3,000 A4 size papers were prepared consecutively at a rate of 60 images per minute in the direction of length of A4 size. After that, the images were evaluated to find entirely no deterioration of the image.

Example 4

The fine resin particles of the following composition were prepared. A recording component was added to the fine resin particles, to obtain an image forming material. The image forming material was subjected to the evaluation of image, viscosity measurement and evaluation of the stability of image in repetitive use in the same manner as in Example 2.

(1) Preparation of fine resin particles and image forming materials.

| | |
|---|---|
| 1. N,N-dimethyl acrylamide | 82 parts |
| 2. Vinylbenzyl trimethylammoium chloride | 15 parts |
| 3. N,N-methylene bisacrylamide *1 | 2 parts |
| 4. Tetramethylethylenediamine *2 | 1 part |

(*1: crosslinking agent, *2: polymerization promoter)

The above monomers were dissolved in 140 ml of water. An ammonium persulfate solution, which had been prepared by dissolving 0.1 part of ammonium persulfate in 1 ml of water, was combined with the above-described monomer solution and the resulting solution was vigorously stirred. The solution thus prepared was dripped into a solution comprising 75 ml of toluene, 25 ml of chloroform and 1 ml of sorbitan trioleate, and the resulting solution was vigorously stirred in an atmosphere of nitrogen. After being stirred for 90 minutes at 70° C., 100 ml of hexane was added to the solution and the solution was stirred again. The solution separated into two layers, the aqueous layer of which was collected. 100 ml of hexane was added to the aqueous solution and the solution was washed under agitation. This washing operation was repeated three times. After the last wash, the hexane was evaporated by means of an evaporator, and a slurry gel was obtained. The gel was washed with water and ethanol alternately and then the solvents were completely evaporated by means of a vacuum drying apparatus to obtain a dry gel polymer. The powdery gel was comminuted by use of a Meteor Rotary Mill LA-P0 (available from Ito Manufacturing Co., Ltd.) to obtain gel polymer powder with a peak particle size of about 10 microns. This powder was dispersed in a 10% ethanol aqueous solution and the dispersion was held in a sufficient equilibrium.

Next, 1% Rhodamine B (available from Mitsubishi Chemical Corp.) aqueous solution was prepared and this solution was dispersed into the above-described gel. Finally, the resulting dispersion was admixed with 5 ml of 10% polyethylene glycol alkyl ether aqueous solution, as a response accelerator, and thus a developer was prepared.

(2) Evaluation of image and the stability in repetitive use

The obtained developer was placed in the recording apparatus of FIG. 1. An image was formed on the photosensitive body by carrying out the exposure according to the condition, i.e., wavelength: 660 nm and light exposure amount: 0.4 J/cm$^2$, while applying a voltage of −250 V between the developer holding roll and the light-transmissive electroconductive layer. The image was transferred to a sheet of recording paper. The transferred image was clear and free of bleeding and fogging of the background. Further, images on 3,000 A4 size papers were prepared consecutively at a rate of 60 images per minute in the direction of length of A4 size. After that, the images were evaluated to find entirely no deterioration of the image.

Example 5

An image forming material was prepared by use of the following composition. The image forming material was subjected to the evaluation of image, viscosity measurement and evaluation of the stability of image in repetitive use in the same manner as in Example 1.

| | |
|---|---|
| 1. C.I. Pigment Red 122 | 2.5 parts |
| 2. the gel polymer prepared in Example 1 | 50 parts |
| 3. glycerin | 2 parts |
| 4. diethylene glycol monobutyl ether | 5 parts |
| 5. colloidal silica | 10 parts |
| 6. water | balance |

The obtained developer was placed in the recording apparatus of FIG. 1. The evaluation of image was then conducted in the same manner as in Example 1. The transferred image was clear and free of bleeding and fogging of the background. Further, images on 3,000 A4 size papers were prepared consecutively at a rate of 60 images per minute in the direction of length of A4 size. After that, the images were evaluated to find entirely no deterioration of the image.

Comparative Example 1

A developer was prepared in the same manner as in Example 5 except that an ammonium salt of a styrene/maleic acid copolymer was used in place of the polymer employed in Example 5. The image forming material was subjected to the evaluation of image and viscosity measurement in the same manner as in Example 1. The obtained image exhibited a markedly foggy background and remarkable bleeding of image even at the initial state.

Comparative Example 2

A developer was prepared in the same manner as in Example 5 except that polyvinyl alcohol (having a degree of polymerization of 2,000) was used in place of the polymer employed in Example 5. The image forming material was subjected to the evaluation of image and viscosity measurement in the same manner as in Example 1. The obtained image exhibited a markedly foggy background and remarkable bleeding of image even at the initial stage.

TABLE 1

| | Developer before the application of electric energy | Viscosity of the developer after the application of electric energy |
|---|---|---|
| Example 1 | solid (gel) | $1.2 \times 10^2$ mPas |
| Example 2 | solid (gel) | $1 \times 10^2$ mPas |
| Example 3 | solid (gel) | $2 \times 10^3$ mPas |
| Example 4 | solid (gel) | $8 \times 10^1$ mPas |
| Example 5 | solid (gel) | $5 \times 10^2$ mPas |
| Comparative Example 1 | solid (gel) | $1 \times 10^5$ mPas |
| Comparative Example 2 | solid (gel) | $>1 \times 10^5$ mPas |

As is apparent from the description of the Examples, the image forming materials of the present invention exhibited a rapid and reversible fluidization by the application of electric energy. The image forming materials of the present invention were free of the image defects, i.e., the fogging of the background and bleeding of the image, which were associated with the electroconductive wet-process developers utilizing conventional water-based developers and with the image making method utilizing such developers and which are indicated in Comparative Examples 1 and 2. Further, the image forming materials of the present invention made it possible to form the image rapidly, and to form the image in a stable manner without presenting any deterioration in the image quality even after repetitive use.

Besides, the aforementioned Examples could provide safe developers, because these were based mainly on water as solvent and were free of the environmental pollution to which the conventional wet-process developers were linked.

What is claimed is:

1. A method for making an image, comprising the steps of:

providing a latent image holding body on which a latent image is formed;

providing an image forming material that is virtually a solid and is converted into a liquid when supplied with an electric field; and converting the image forming material into a liquid by the application of the electric field and wetting and developing the latent image on the latent image holding body with a recording component contained in the image forming material.

2. The method of claim 1, wherein the image forming material comprises resin particles and the recording component, the recording component comprising a colorant and a solvent, and wherein the recording component is held inside the resin particles and wherein the resin particles can, by the application of an electric field, release the recording component to liquefy the image forming material.

3. The method of claim 2 wherein the image forming material further comprises a response accelerator.

4. The method of claim 2 wherein the resin particles are made of a resin that has a three-dimensionally cross-linked structure derived from at least one of an acrylamide derivative monomer and an acetamide derivative monomer.

5. The method of claim 2 wherein the solvent that is an ingredient of the recording component is water.

6. The method of claim 1 wherein the image forming material comprises resin particles and the recording component is held inside the resin particles, wherein the recording component comprises a colorant and a solvent, wherein the resin particles are virtually a solid at room temperature and can, by the application of an electric field, be converted into a liquid to release the recording component, wherein the resin particles are made of a resin that has a three-dimensionally cross-linked structure derived from at least one of an acrylamide derivative monomer and an acetamide derivative monomer; and wherein the solvent is water.

7. The method of claim 1 wherein an electrostatic attraction force which acts between the latent image on the latent image holding body and the recording component of the image forming material, is increased selectively in the area corresponding to the latent image, and the latent image is wetted and developed with the recording component contained in the image forming material.

8. The method of claim 1 wherein the image forming material is recharged with recording component so that the image forming material can be reused to repetitively form the image.

9. The method of claim 1 wherein the developed image is transferred to a sheet of recording paper.

* * * * *